US006718962B2

(12) United States Patent
Adcock

(10) Patent No.: US 6,718,962 B2
(45) Date of Patent: Apr. 13, 2004

(54) ARCHERY BOW AND LIMBS THEREFOR

(75) Inventor: O. L. Adcock, Roswell, NM (US)

(73) Assignee: A&H Archery, LLC, Glencoe, IL (US)

( * ) Notice: Subject to any disclaimer, the term of this patent is extended or adjusted under 35 U.S.C. 154(b) by 0 days.

(21) Appl. No.: 10/195,746

(22) Filed: Jul. 15, 2002

(65) Prior Publication Data

US 2004/0007223 A1 Jan. 15, 2004

(51) Int. Cl.[7] ..... F41B 5/00
(52) U.S. Cl. ..... 124/23.1; 124/25.6
(58) Field of Search ..... 124/23.1, 25.6

(56) References Cited

U.S. PATENT DOCUMENTS

| | | | |
|---|---|---|---|
| 1,960,477 | A | 5/1934 | Cowdery |
| 4,088,111 | A | 5/1978 | Li |
| 4,122,821 | A | 10/1978 | Mamo |
| 4,989,577 | A | 2/1991 | Bixby |
| 6,067,974 | A | 5/2000 | Islas |
| 6,098,607 | A | 8/2000 | Strother |
| 6,105,564 | A | 8/2000 | Suppan |
| 6,321,736 | B1 | 11/2001 | McPherson |
| 2002/0029773 | A1 | 3/2002 | Park |

OTHER PUBLICATIONS

American Society for Testing and Materials, "Standard Specification for Determining the Rating Velocities of an Archer Bow," Designation: F 1544–99, Feb. 2000, pp. 1–2, West Conshohocken, PA.

*Traditional Bowhunter Magazine*, Jun./Jul. 2002, pp. 1–106, TBM, Inc., Boise, ID.

"Cabela's Archery 2002," 2002, pp. 1–176, Cabela's, Sidney, NE.

*Lone Wolf Custom Bows* (visited Mar. 4, 2003), <http://www.lonewolfcustombows.com/longbows.htm>.

Declaration of John Havard, signed Apr. 3, 2003.

*Primary Examiner*—John A. Ricci
(74) *Attorney, Agent, or Firm*—Wallenstein Wagner & Rockey, Ltd.

(57) ABSTRACT

The invention relates to an archery bow having a handle with a longitudinal axis and first and second handle ends. The bow also has an upper limb and a lower limb extending generally in a direction along the longitudinal axis. Each limb has first and second edges defining a limb width, a limb thickness, a proximal end, a distal end, and a working region between the proximal and distal ends of each limb. The first and second handle ends are attached to each limb at the respective proximal end of each limb. The proximal end of each limb has a proximal width and the distal end of each limb has a distal width. Each limb further has a concave surface extending generally between the first and second edges. Each concave surface has an opening and first and second transition points located at opposing sides of the opening of the concave surface. There is a transverse width defined by a distance between the transition points, which transverse width is substantially unchanged when the bow is drawn to a full draw position as compared to when the bow is in an undrawn position. The concave surface(s) can instead be a convex surface(s) in various forms of the present invention.

77 Claims, 5 Drawing Sheets

1a
1b
1c

H1
T1
W1

H2
T2
W2

H3
T3
W3

2a
2b
2c

H7
W7

H8
W8

H9
W9

FIG.3 FIG.4 FIG.5
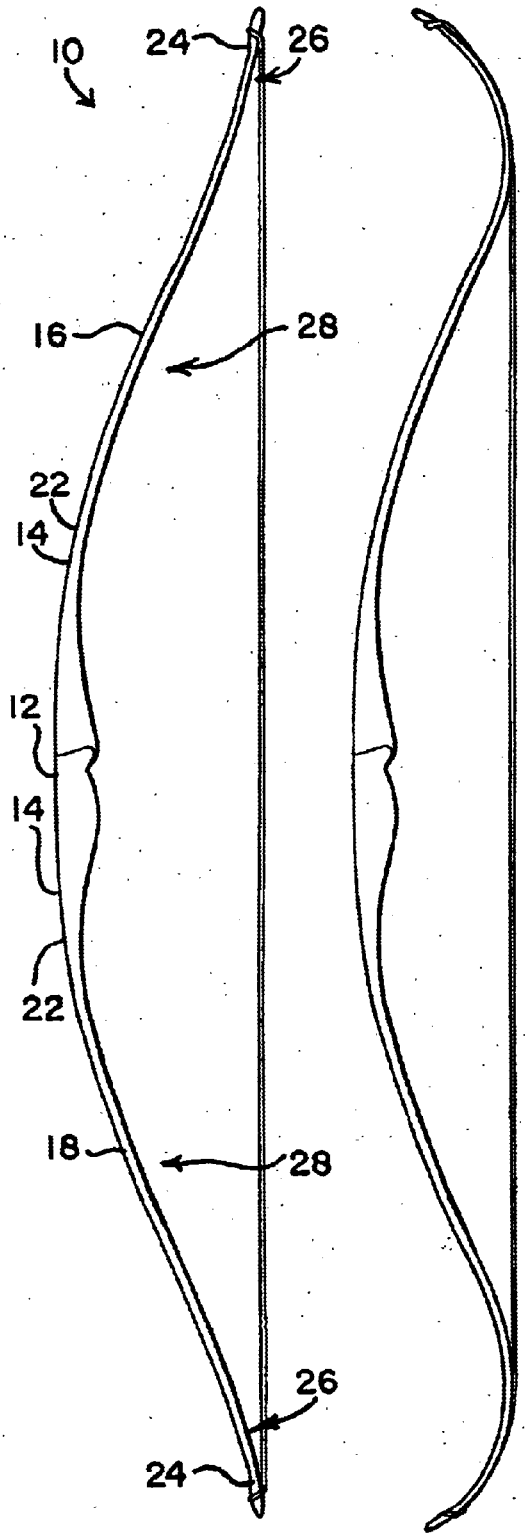
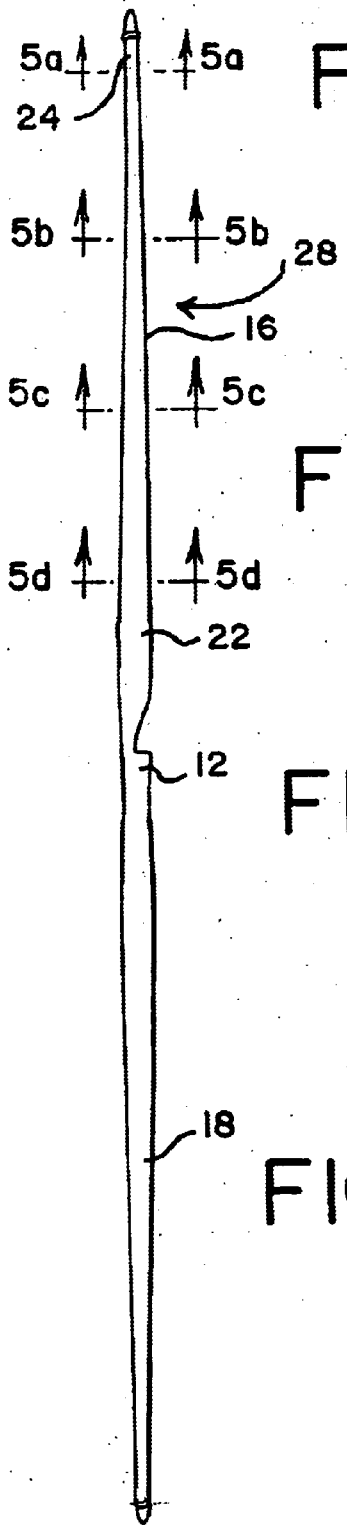
FIG.5a
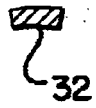
FIG.5b
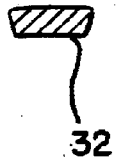
FIG.5c
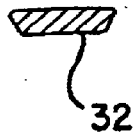
FIG.5d
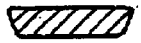

ARCHERY BOW AND LIMBS THEREFOR

TECHNICAL FIELD

The present invention relates generally to archery bows. Specifically, the present invention relates to an improved archery bow and concave-shaped limbs therefor with improved efficiency, decreased limb weight, and increased strength.

BACKGROUND OF THE INVENTION

Conventional archery bows typically have a stationary handle that does not bend and flexible limbs that do bend when the bow is drawn. This allows the bow to be held at the handle while the string is drawn back to deform the limbs. When the string is released, the limbs act like a spring in returning to their original undrawn position. The energy that was stored in the process of drawing the bow and deforming the limbs is used to accelerate three things when the string is released—the string, the arrow, and the limbs themselves. If the mass of the limbs can be reduced while still storing the same amount of energy, more of the stored energy can be transferred to the arrow and less wasted on accelerating the limbs forward. Another very important consideration is where this mass reduction occurs along the longitudinal axis of the limbs. That portion of the limbs that moves the farthest distance upon being released from the fully drawn position is even more significant. By removing mass from this outer portion of the limbs the benefits of reducing limb mass are maximized. In a well-made bow of conventional design up to 45% of the total stored force is unusable waste dissipated by the bow in restoring its limbs to the undrawn position. Such waste force can take the form of hand shock, vibration, and noise.

An archer can not materially change his/her draw length because of the fact that draw length is a function of physical size and arm length. So the only practical way to increase arrow speed is to increase the draw weight of the bow. Once again the archer is limited by his/her physical strength and corresponding ability to draw the bow. Raising the draw weight of a bow requires that the limbs be made thicker or wider or both. This has the unfortunate consequence of increasing the mass of the limbs. And as previously discussed, adding mass weight to the limbs reduces the efficiency of any given bow limb.

Conventional bows, either traditional or compound, employ limb geometries that have back and belly surfaces that are essentially perpendicular to the longitudinal axis of the bow and that are essentially parallel to one another. With this design concept, increasing the draw weight of a bow with conventional limb design requires that the limbs be made wider or thicker or both. Once again the effect of this is increased mass in the limbs which results in more energy waste upon the string being released.

Prior efforts to resolve these issues have been largely unsuccessful without adding weight to the bow structure, which also decreases bow efficiency. For example, compound bows add pulley systems and cams to the distal ends of the bow limbs. The addition of such apparatus to the limbs adds weight to the working bow structure, sometimes even doubling the weight of the bow. The addition of pulley systems and cams makes the bow easier to hold at full draw for aiming purposes, but adds weight. This added weight requires more energy to restore the limbs to the undrawn position. Further prior efforts have included the addition of springs and stabilizers to the bow structure. This dampens the effects of some of the waste force being dissipated in the form of hand shock, vibration, and noise, making the bow more comfortable for an archer to shoot. However, it does not decrease the overall amount of waste force being lost. Sometimes such additions even increase the waste force by adding to the overall weight of the working limb structure. These additional moving and working parts can also wear out and malfunction, and may need replacing, thereby making such additions potentially less advantageous U.S. Pat. No. 4,122,821 to Mamo discloses an archery bow in which there are limbs outwardly extending from a center grip portion, and the cross-sections of the limbs at points along the longitudinal axis of the limbs are of predetermined curved configuration such that on drawing of the bow and decreasing of the radius of curvature of the longitudinal axis of the bow, there will occur at a predetermined rate, increase in the radii of transverse or cross-sectional curvature of the limbs.

Each bow limb structure has cross-sectional configurations that are curved in its transverse planes which are substantially perpendicular to its longitudinal axis. The configurations have predetermined dimensions of thickness and predetermined dimensions of extent of curvature which progressively vary at different sections of the limb structure. With increase of draw of the limb structures, the radius of longitudinal curvature significantly decreases while the radius of curvature of each configuration significantly increases in a progressive manner and at different rates at different sections.

Compound bows were originally developed because of an interest in reducing the amount of effort required to hold a bow at the fully drawn position so as to increase the ability of the archer to aim more carefully. Mamo sought to design a bow limb that would mimic the compound bow's draw weight reduction at the fully drawn position.

U.S. Pat. No. 6,105,564 to Suppan discloses a bow with limbs which have a curved cross-section and whose longitudinal edges are oriented in a direction away from the bowstring, the cross-section of the limb (2, 3) extending with continuous curvature between the bow edges (2', 3'), at least in the tensioned state.

As a result, there occurs a significant two-way movement during drawing of the bow, namely bending of the bow itself, on the one hand, and significant lateral spreading-apart of the longitudinal edges, on the other hand, such that the release movement proceeds in predetermined manner, namely by straightening of the bow itself with simultaneous forward movement of the edges relative to the bottom of the bow, thereby achieving faster restoration of the bow to its initial state, which leads to increased projection velocity for the bow.

U.S. Pat. No. 4,989,577 to Bixby discloses a power unit archery bow wherein a frame member is secured with respect to a first end of at least one limb member by a spring-actuated power unit. A bow string secured to a second distal end of the limb member is adapted to engage an arrow and to be drawn rearwardly by a user. Retraction of the bow string causes the limb member to rotate rearwardly, whereby the entire length of the limb member is utilized to load the spring member of the power unit.

Upon release of the bow string, the energy stored by the power unit spring is instantaneously released, being transmitted to the limb member to rotate the limb member to its original position so as to straighten the bow string and propel the arrow forward. Because the entire length of the limb member provides leverage to the power unit, the requisite pull force for the bow is greatly reduced.

These and other patents not specifically mentioned disclose attempts at enhancing performance of particular bows by adding various springs or frame work or power units or stabilizers or wheels and pulleys. None of these patents address the fundamental benefits of minimizing the overall mass of the working portion of a bow limb.

The present invention is provided to solve these and other problems.

SUMMARY OF THE INVENTION

The present invention is generally directed to using stiffening geometry to strengthen and therefore lighten the bow limb. The benefit of maintaining bow limb strength while significantly reducing limb mass is beneficial to traditional bows including recurves, reflex/deflex longbows, straight-limbed longbows, as well as to non-traditional bows consisting primarily of compound bows. Bows utilizing the present invention in their limb design will achieve equivalent levels of strength and stiffness with significantly less mass in the limbs when compared with a conventional bow. Bows utilizing the present invention will store just as much energy (all other things being equal) as bows utilizing conventional limb design. Draw/force curves for two otherwise similar bows, whether traditional or compound, will look essentially the same (See FIG. 10). However, because bows utilizing the present invention will have less mass in the limbs, more of the stored energy will be transmitted to the arrow.

Thus, in one embodiment, the present invention is directed to a bow with a handle having a longitudinal axis and first and second handle ends. The bow also has an upper limb and a lower limb extending generally in a direction along the longitudinal axis, each limb comprising first and second edges defining a limb width, a limb thickness, a proximal end, a distal end, and a working region between the proximal and distal ends of each limb. The first and second handle ends are attached to each limb at the respective proximal end of each limb. The proximal end of each limb has a proximal width and the distal end of each limb has a distal width. Each limb further has a concave surface extending generally between the first and second edges, each concave surface having an opening and first and second transition points located at opposing sides of the opening of the concave surface. A transverse width is defined by a distance between the transition points, wherein the transverse width is substantially unchanged when the bow is drawn to a full draw position as compared to when the bow is in an undrawn position. The transverse width can be the same as the limb width, and the first and second transition points can be located at the first and second edges, respectively.

In another embodiment, the present invention is directed to a limb for a bow having first and second edges defining a limb width, a limb thickness, a proximal end, a distal end, and a working region between the proximal and distal ends of the limb, wherein the proximal end of the limb has a proximal width and the distal end of the limb has a distal width. The limb further has a concave surface extending generally between the first and second edges, the concave surface having an opening and first and second transition points located at opposing sides of the opening of the concave surface. A transverse width is defined by a distance between the transition points, wherein the transverse width is substantially unchanged when the bow is drawn to a full draw position as compared to when the bow is in an undrawn position.

In an additional embodiment, the present invention is directed to a bow having a handle with a longitudinal axis and first and second handle ends. The bow also has an upper limb and a lower limb extending generally in a direction along the longitudinal axis. Each limb has first and second edges defining a limb width, a limb thickness, a proximal end, a distal end, and a working region between the proximal and distal ends of each limb. The first and second handle ends are attached to each limb at the respective proximal end of each limb, wherein the proximal end of each limb has a proximal width and the distal end of each limb has a distal width. Each limb further has a concave surface extending generally between the first and second edges, each concave surface having an opening and first and second transition points located at opposing sides of the opening of the concave surface. A transverse width is defined by a distance between the transition points. The bow further has a draw force that is required to draw the bow from an undrawn position to a draw length, wherein the draw force required to draw the bow increases as the draw length increases within the vicinity of a full draw position and beyond the full draw position.

In yet a further embodiment, the present invention is directed to a limb for a bow having first and second edges defining a limb width, a limb thickness, a proximal end, a distal end, and a working region between the proximal and distal ends of the limb, wherein the proximal end of the limb has a proximal width and the distal end of the limb has a distal width. The limb further has a concave surface extending generally between the first and second edges, the concave surface having an opening and first and second transition points located at opposing sides of the opening of the concave surface. A transverse width is defined by a distance between the transition points. The transverse width can be the same as the limb width, and the first and second transition points can be located at the first and second edges, respectively. There is also a draw force that is required to draw the bow from an undrawn position to a draw length, wherein the draw force required to draw the bow increases as the draw length increases within the vicinity of a full draw position and beyond the full draw position.

Other features and advantages of the invention will be apparent from the following specification taken in conjunction with the following drawings.

BRIEF DESCRIPTION OF THE DRAWINGS

FIG. 3 is a side view of a longbow of the present invention.

FIG. 4 is a side view of a recurve bow of the present invention.

FIG. 5 is a front view of a bow of the present invention.

FIGS. 5*a*, 5*b*, 5*c*, and 5*d* show cross-sectional views of the bow of FIG. 5 at section lines 5*a*—5*a*, 5*b*—5*b*, 5*c*—5*c*, and 5*d*—5*d* along the length of a limb of one embodiment of the present invention.

DETAILED DESCRIPTION

Figures 1, 1A, 1B, 1C, 2, 2A, 2B, 2C:
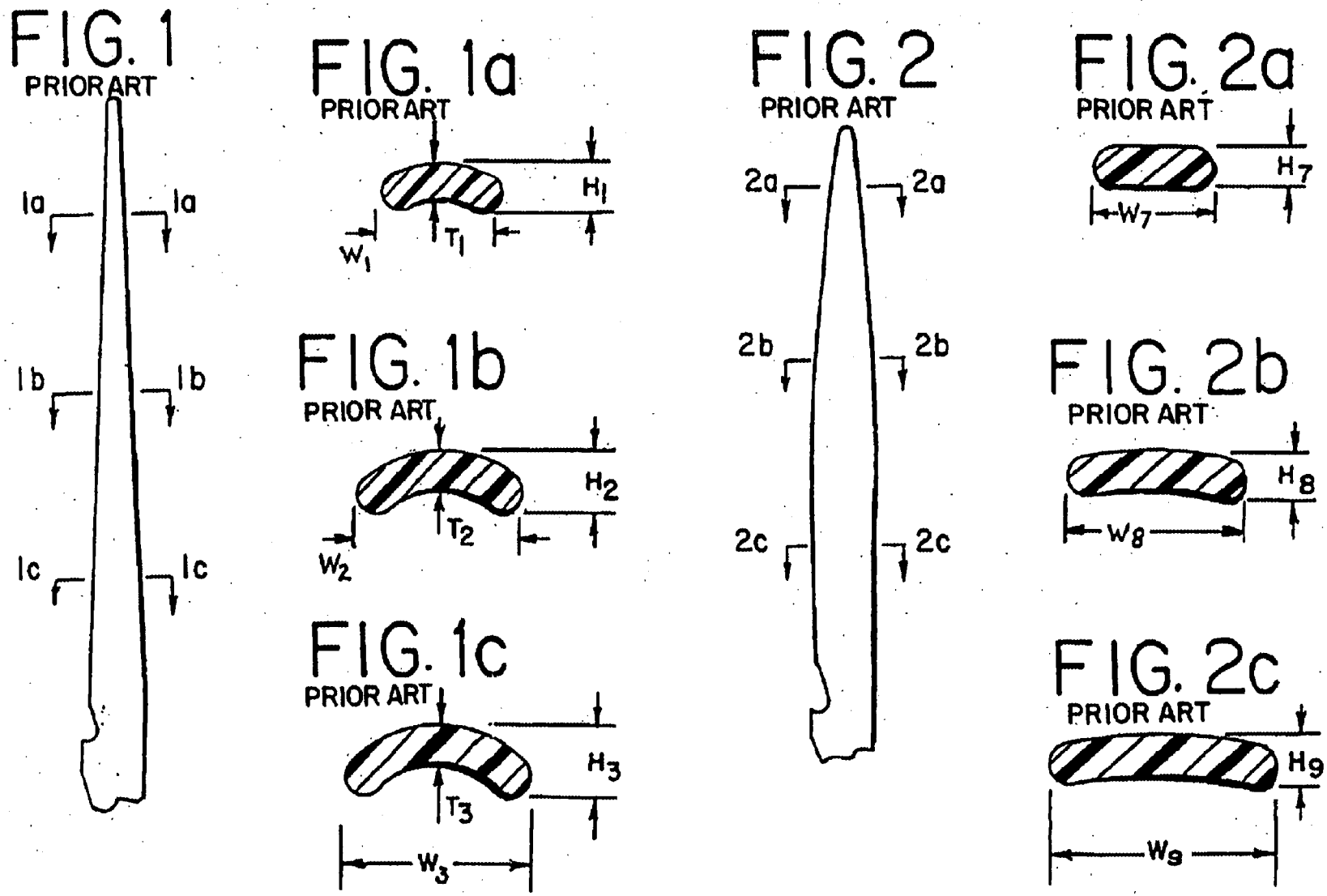
FIG. 1 PRIOR ART
FIG. 1a PRIOR ART
FIG. 1b PRIOR ART
FIG. 1c PRIOR ART
FIG. 2 PRIOR ART
FIG. 2a PRIOR ART
FIG. 2b PRIOR ART
FIG. 2c PRIOR ART
FIG. 1 shows a partial front view of a prior bow in an undrawn position.
FIGS. 1*a*, 1*b*, and 1*c* show cross-sectional views of a prior bow at section lines 1*a*—1*a*, 1*b*—1*b*, and 1*c*—1*c* along the length of a limb as shown in FIG. 1.
FIG. 2 shows a partial front view of the prior bow of FIG. 1, in a full draw position.
FIGS. 2*a*, 2*b*, and 2*c* show cross-sectional views of a prior bow at section lines 2*a*—2*a*, 2*b*—2*b*, and 2*c*—2*c* along the length of a limb as shown in FIG. 2.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention uses improved cross-sectional geometry to make the bow limbs stronger and stiffer which simultaneously enables the limbs to be made thinner or narrower or both—thereby reducing limb mass. Building bow limbs with back and belly surfaces that are anything other than flat and parallel to one another enables the limbs to be strengthened without having to widen or thicken them. By utilizing one or more limb geometries that strengthen and stiffen the limb at key points along the limb axis it is possible to significantly reduce the limb mass while still building a bow limb that stores as much energy as a bow limb of conventional design. The result of this limb mass reduction is easily measured by comparing two bows of similar draw weight but with one employing conventional limb design technology and the other one employing the present invention technology. All other things such as bow type, string mass, arrow mass, draw weight, and draw length being equal, the bow employing the improved limb design found in the present invention will propel an arrow up to 20% faster than the bow utilizing conventional limb design. This improvement in bow efficiency enables the archer to either shoot the same arrow at a greater speed from a bow utilizing the present invention (all other things being equal) or enables the archer to use an improved bow of the present invention at a lighter draw weight and still achieve the same arrow speed as with a bow employing conventional limb design with a much higher draw weight. Another significant improvement of the present invention over bows utilizing conventional limb design is a noticeable reduction in hand shock. This reduction in hand shock greatly increases the comfort with which an archer can shoot a bow. Of particular importance to tournament archers, the improvement in stability and smoothness attributable to reduced limb mass (particularly in the distal portions of the limbs) can increase accuracy of the bow.

As shown in FIGS. 1, 1*a*, 1*b*, 1*c*, 2, 2*a*, 2*b*, and 2*c*, the prior bow has limbs with a first radius of curvature when the bow is undrawn and a second radius of curvature when the bow is in the full draw position, the first radius of curvature being smaller than the second radius of curvature. As the prior bow is drawn and the radius of curvature of the prior bow increases, the width of the limbs also increases as shown by the differences between the undrawn widths W1, W2, and W3 as compared to the respective fully drawn widths W7, W8, and W9.

As shown in FIG. 3, one embodiment of the invention is an archery bow 10 having a handle 12 with a longitudinal axis and first and second handle ends 14. The bow 10 also has an upper limb 16 and a lower limb 18 extending generally in a direction along the longitudinal axis. Each limb 16, 18 has first and second edges defining a limb width, which is the distance from left to right when looking at the back of the bow 10 from a front view, i.e. from the target's eyes. The limb width can be constant or it can vary over the length of the limb 16, 18.

As shown in FIG. 3, each limb 16, 18 has a proximal end 22, a distal end 24, a tip 26 located at the distal end 24, and a working region 28 between the proximal and distal ends 22, 24 of each limb 16, 18. The proximal end 22 is the portion of the limb 16, 18 nearest the handle 12. The distal end 24 is the portion of the limb 16, 18 located farthest from the handle 12. The tip 26 is the portion of the limb 16, 18 where the string is nocked at the distal end 24 of the limb 16, 18. The working region 28 is the part of the limb 16, 18 that moves when the bow 10 is drawn and released. The first and second handle ends 14 are attached to each limb 16, 18 at the respective proximal end 22 of each limb 16, 18. The proximal end 22 of each limb 16, 18 has a proximal width and the distal end 24 of each limb 16, 18 has a distal width. Optionally, the distal width may be less than the proximal width. Another option is for the limb width to decrease gradually from the proximal end 22 of the limb 16, 18 to the distal end 24 of the limb 16, 18. For example, in one embodiment of the invention in a long bow arrangement, the limb width decreases gradually from approximately 1.25 inches at the proximal end 22 of the limb 16, 18 near the handle 12 to approximately .50 inches at the distal end 24 of the limb 16, 18 near the string nock.

Figure 6A:
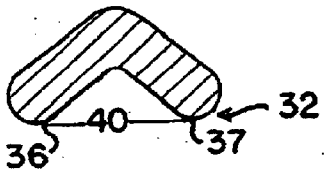
FIGS. 6*a*, 6*b*, and 6*c* show views for various embodiments of a bow of the present invention.
Figure 6B:
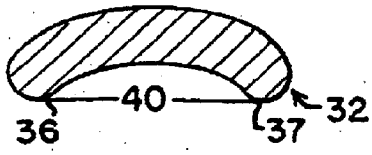
Figure 6C:
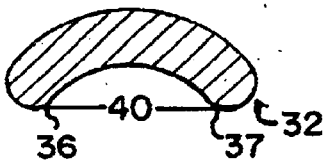

As shown in FIGS. 5, 5*a*, 5*b*, 5*c*, and 5*d*, each limb 16, 18 further has a concave surface 32 extending generally between the first and second edges. The concave surface 32 can be any shape, including, but not limited to, a part of a circle, an ellipse, a polygon, or a polygon with curved corners. For example, as shown in FIGS. 6*a*, 6*b* and 6*c*, the concave surface 32 can be V-shaped, elliptical-type, circular-type, respectively, or some other shape. The concave surface 32 may be on the belly side or on the back side of each limb 16, 18. The belly side of the limb 16, 18 faces the shooter and the back side of the limb 16, 18 faces the target. As shown, the belly surface is concave and the back surface is convex. As indicated below, such surfaces can be of several different combinations, including concave and concave, convex and concave, concave and convex, and convex and convex, respectively.

As shown in FIGS. 6*a*, 6*b*, and 6*c*, the concave surface 32 has an opening and first and second transition points 36, 37 located at opposing sides of the opening of the concave surface 32. There is a transverse width 40 defined by a distance between the transition points 36, 37, which transverse width 40 is substantially unchanged when the bow 10 is drawn to a full draw position as compared to when the bow 10 is in an undrawn position. The transition points 36, 37 are defined as any two points on opposing sides of the concave surface 32 by which it can be discerned whether the transverse width 40 between the two points has changed when the bow 10 is in the drawn position as compared to when the bow 10 is in the undrawn position. The transverse width 40 can be the same as the limb width, and the first and second transition points 36,37 can be located at the first and second edges, respectively. Optionally, the transverse width 40 of the bow 10 in the undrawn position changes by not more than 0.010 inches, preferably by less than 0.005 inches, and more preferably by less than 0.001 inches, when the bow 10 is drawn to the full draw position. It is also possible that a bow 10 of the present invention would exhibit no measurable change in the transverse width 40 when the bow 10 is drawn to the full draw position from the undrawn position. The transverse width 40 may be measured at any consistent point along the working region 28 of the limb 16, 18. For example, one possibility would be to measure the transverse width 40 at a central portion of the working region 28, both when the bow 10 is undrawn and fully drawn.

In one embodiment, as shown in FIGS. 5, 5*a*, 5*b*, 5*c* and 5*d*, the concave surface 32 may have a radius of curvature when the bow 10 is undrawn, which radius of curvature remains substantially unchanged when the bow 10 is drawn to a full draw position. The radius of curvature may also decrease from the proximal end 22 to the distal end 24 of the limb 16, 18 when the bow 10 is in the undrawn position. For example, as shown in FIGS. 5, 5*a*, 5*b*, 5*c* and 5*d*, the radius of curvature decreases from approximately infinity where the proximal end 22 of the limb 16, 18 attaches to the handle 12, to approximately 48 inches at a point near the proximal end 22 of the working region 28, to approximately 20 inches at a point near the distal end 24 of the working region 28, to approximately 12 inches at the distal end 24 of the limb 16, 18. These radii remain substantially unchanged when the bow 10 is undrawn as compared to when the bow 10 is drawn to the full draw position.

Figure 9A:
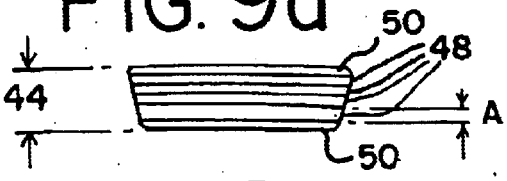
FIGS. 9*a* and 9*b* are partial side views of two different sections of a limb of the present invention.
Figure 9B:
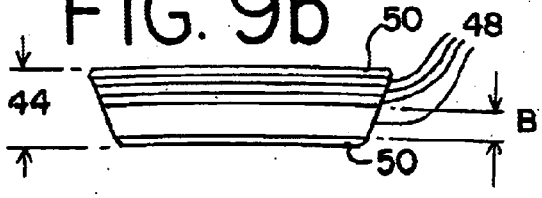

As shown in FIGS. 9*a* and 9*b*, each limb 16, 18 also has a limb thickness 44. The limb thickness 44 is the distance from the back of the bow 10 to the belly of the bow 10. In one embodiment, the limbs 16, 18 are formed of multiple layers extending generally in the direction of the longitudinal axis. Optionally, the multiple layers may be made up of one core layer 48 positioned between two outer layers 50. Or, there may be multiple core layers 48. The core layers 48 may be parallel or tapered or both. If one or more core layers 48 is tapered, the taper will generally run in a direction along the longitudinal axis. Where there are multiple layers, the limb thickness 44 is equal to the sum of the thicknesses of all of the layers. Limb thickness 44 will most likely vary from bow to bow. It is also contemplated that the limb thickness 44 can vary along a single limb 16, 18. This may be the case where one or more core layers 48 is tapered as show in FIGS. 9*a* and 9*b* by the different thicknesses A and B along the limb 16, 18. As shown, the belly surface is concave and the back surface is convex. As indicated below, such surfaces can be of several different combinations, including concave and concave, convex and concave, concave and convex, and convex and convex, respectively.

In one embodiment, the two outer layers 50 are each made of approximately 0.040 inch thick fiber glass and/or carbon fiber. This embodiment has multiple core layers 48, two of which are parallel and one of which is tapered. Each of the parallel core layers 48 is approximately 0.060 inch thick bamboo. The tapered core layer 48 is composed of bamboo, which varies in thickness from about 0.110 inches at the mid-point of the handle 12 to about 0.046 inches at the tip 26 of the limb 16, 18. Various other materials may be used for the outer layers 50, including but not limited to fiberglass, carbon, KEVLAR, or any other man-made or natural materials. Similarly, the core layers 48 may also be made of various materials, including but not limited to fiberglass, bamboo, various woods, carbon, KEVLAR, foam, syntactic foam or any other man-made or natural materials.

The working region 28 and the tip 26 of each limb 16, 18 have an optimal weight for improving the efficiency of the limb 16, 18. This optimal weight is dependent upon the limb thickness 44, the concave surface 32 construction, the limb width, the weight of the materials used to construct the limb 16, 18, and the overall dimensions of the bow 10. In one embodiment, a longbow with a total undrawn longitudinal length of approximately 64 inches, the optimal weight of each limb 16, 18 is approximately 1541 grains and the working region 28 is approximately 23 inches per limb 16, 18. Using otherwise similar materials and comparing this longbow 10 of the present invention to an otherwise similar longbow with conventional limb design, this represents a weight savings of approximately 150 grains in each limb 16, 18, for a total weight savings of approximately 300 grains.

All bows 10 have a waste force defined generally by a total force stored in the bow 10 when the bow 10 is in a drawn position, less a transfer force that is transferred to an arrow at the point of release of the arrow. A bow 10 of the present invention can have a waste force that is less than 25%, preferably less than 15%, and more preferably less than 10% of the total force stored in the bow 10 when the bow 10 is drawn to the full draw position and released.

Figure 10:
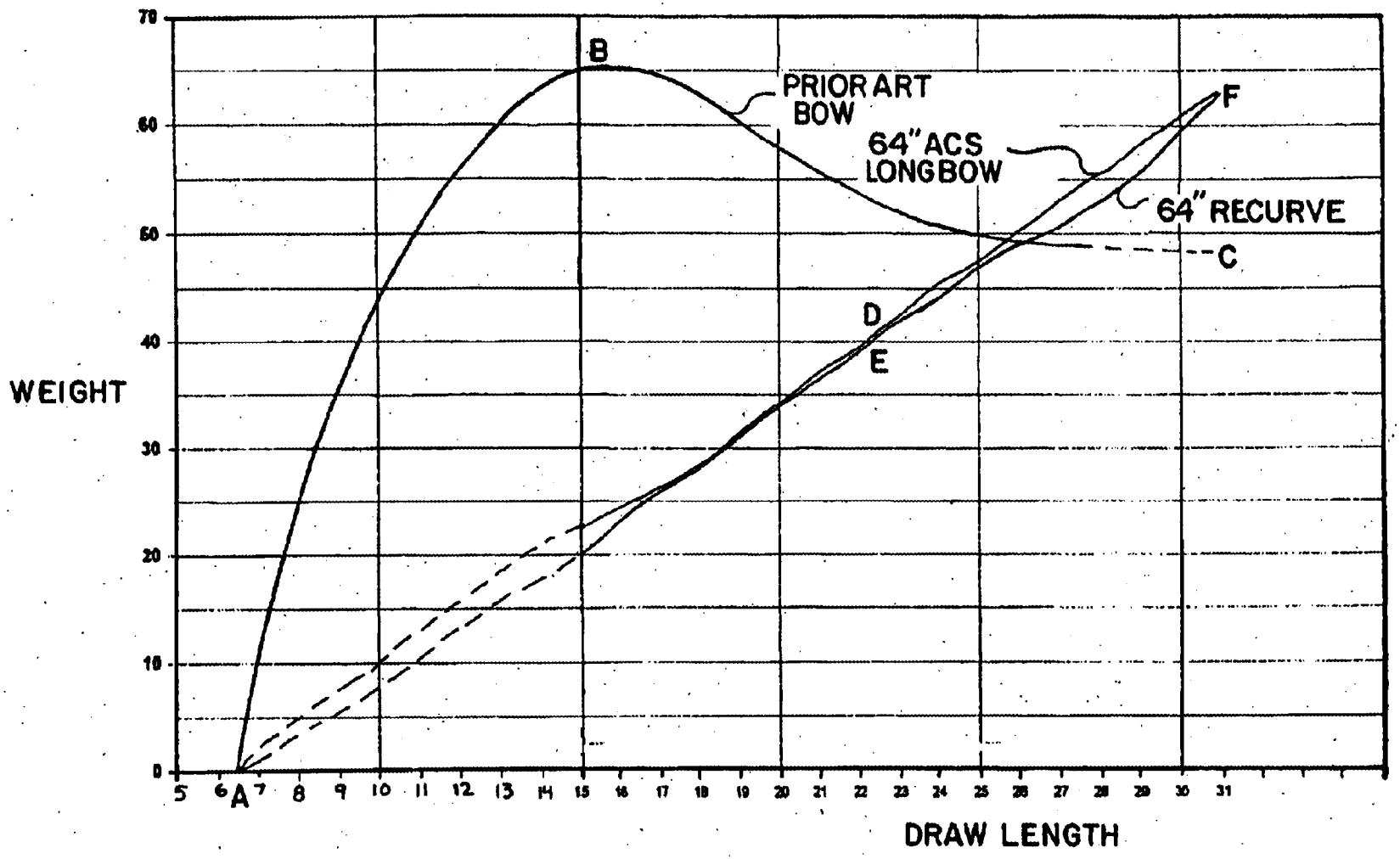
FIG. 10 is a comparison graph showing draw force vs. draw length for a longbow of the present invention, a prior art recurve bow with conventional limbs, and a bow disclosed in a prior art patent.

Archery bows 10 also have a draw force or draw weight that is required to draw the bow 10 to a draw length. This is known as the draw characteristics of the bow 10. FIG. 10 illustrates the draw characteristics of three separate bows: a 64 inch longbow of the present invention, a 64 inch prior recurve bow with conventional limbs, and a prior bow of U.S. Pat. No. 4,122,821 to Mamo. The draw weight in pounds is plotted on the vertical axis and the draw length in inches is plotted on the horizontal axis. It should be noted that each of the plots have been extrapolated using dotted lines to facilitate discussion.

As shown in FIG. 10, the prior art curve ABC increases at a decreasing rate from point A to point B. Then, from point B to point C, the prior art curve ABC decreases and starts to level off somewhere near point C. Curve ABC decreases from point B to point C because the prior art bow limbs are constructed such that they have a curved cross-section that flattens out as the bow is drawn. As shown in FIGS. 1, 1*a*, 1*b*, 1*c*, 2, 2*a*, 2*b*, and 2*c*, the prior bow has limbs with a first radius of curvature when the bow is undrawn and a second radius of curvature when the bow is in the full draw position, the first radius of curvature being smaller than the second radius of curvature. As the prior bow is drawn and the radius of curvature of the prior bow increases, the width of the limbs also increases. This creates the effect shown in curve ABC, so that once the archer has drawn the bow using a jerking motion over the "hump" at point B, the bow becomes easier to hold in a drawn position. The bow is easier to hold because, as curve ABC illustrates, the force decreases for draw lengths over about 16 inches. The bow becomes even easier for the archer to hold as the draw length is increased to about 22 inches. After about 22 inches, curve ABC begins to level off, so that the bow requires essentially the same amount of force to draw the bow from about 22 inches to about 30 inches.

As shown in FIG. 10, curves ADF and AEF represent a 64 inch longbow of the present invention and a prior 64 inch recurve bow with conventional limbs, respectively. One difference in these two bow is that the AEF recurve bow has a limb thickness that is substantially greater than the limb thickness of the ADF longbow. Thus, the overall weight of the AEF recurve bow is substantially greater than the weight of the ADF longbow. Curves ADF and AEF of the present invention both increase in a fairly linear fashion from point A to point F. Therefore, as the draw length increases for both curve ADF and curve AEF, the draw force or weight required to draw the bow 10 also increases. As can be seen from curves ADF and AEF, the draw weight continues to increase at substantially all draw lengths along a draw path extending from the undrawn position to a useable draw position beyond the full draw position. Therefore, unlike the prior ABC curve bow, there is no substantial point at which the bow 10 of the present invention (curve ADF) becomes substantially easier to hold in a drawn position or beyond. This is because the bow 10 of the present invention has a concave surface (and/or convex surface as described below) that having a transverse width that is substantially unchanged when the bow 10 is in an undrawn position as compared to when the bow 10 is in a drawn position. Therefore, the draw force required to draw a bow 10 of the present invention generally increases as the draw length increases at substantially all points along the draw path up to the full draw position, within the vicinity of and including the full draw position, and beyond the full draw position. As shown in FIG. 10, the bow of curve ADF as compared to the bow of curve AEF stores essentially the same amount of energy throughout the draw/force curve. The difference is that since the limb thickness and respective weight of the bow of curve ADF as compared to the bow of curve AEF is substantially less, the efficiency of the bow of curve ADF as compared to the bow of curve AEF is substantially greater. The applicant has tested at least one bow of the present invention, and at least one such bow has achieved an efficiency of at least 85% at an Archery Manufacturers and Merchants Organization (AMO) standard of 60#@30 inches with a 540 grain arrow. This indicates that the waste force is 15% or less. The applicant believes that the present invention can achieve at least a 90% efficiency.

The data used for FIG. 10 was obtained by independently testing a 64 inch longbow of the present invention with a draw weight of 60 lbs. at 30 inches, and a 64 inch prior recurve bow with the same draw weight. ASTM Standard Specification for Determining the Rating Velocities of an Archery Bow (Designation F 1544-99) was used for taking measurements. Draw length and force measurements taken and plotted on the graph depicted in FIG. 10. The data regarding the prior art bow of curve ABC was taken from FIG. 7 of U.S. Pat. No. 4,122,821 to Mamo.

With reference to FIG. 10, it should be understood that comparing the performance of a longbow of the present invention with a representative bow of the prior art is important to an understanding of the improvements in the performance attributable to the present invention. It is well known among archers and bowyers that a well-designed recurve bow will ordinarily out-perform a well-designed longbow. For hundreds of years, archers and bowyers around the world have been building recurve bows to achieve improvements in performance over that which is achievable with a well-designed longbow. With the goal of comparison-testing in mind, over 20 of the best-known available recurve bows were tested in an effort to find the most efficient recurve bow as a basis for comparison with the longbow of the present invention. The comparison test data which follows results from comparing the most efficient recurve available at the time of development of the present invention.

Both the prior art recurve as well as the longbow of the present invention required 60 pounds of force to be drawn to 30". After measuring the draw/force curves for each bow, two different weight arrows were shot from each bow through a chronograph in order to measure the improvement in performance which can reasonably be attributed to the limb design described in this present invention. Following the guidelines from ASTM Standard Specification for Determining the Rating Velocities of an Archery Bow (Designation F 1544-99), the speed with which each bow shot the two arrows was determined. Taking repeated measurements for each bow with each arrow, an average arrow speed, measured in feet per second (fps), was determined for each bow. The longbow of the present invention shot the 540 grain arrow at an average of 206 fps and the 645 grain arrow at an average velocity of 196 fps. The comparison prior art recurve shot the 540 grain arrow at an average of 196 fps and the 645 grain arrow at an average velocity of 188 fps. Knowing the mass of each arrow and the average velocity of each arrow, the kinetic energy of each arrow is easily calculated in foot-pounds (ft-lbs). At 206 fps the 540 grain arrow has a kinetic energy of 51 ft-lbs, and at 196 fps the 540 grain arrow has a kinetic energy of 46 ft-lbs. At 196 fps the 645 grain arrow has a kinetic energy of 55 ft-lbs and at 188 fps the 645 grain arrow has a kinetic energy of 47 ft-lbs. By calculating the area under the draw force curve for the two bows being compared, it was found that the longbow of the present invention had a stored energy of 60 ft-lbs and the recurve representing the best example of the prior art had a stored energy of 59 ft-lbs. Finally, by comparing the kinetic energy (KE) imparted to the test arrows by each bow, it is possible to calculate the percentage of stored energy which is imparted to each arrow by each bow. The efficiency of the bow utilizing limbs of the present invention for the 540 grain arrow was 85% and for the 645 grain arrow the present invention bow had an efficiency of 92%. The efficiency of the prior art recurve bow with conventional limbs had an efficiency of 78% for the 540 grain arrow and 80% for the 645 grain arrow. Bowyers have a generally accepted rule of thumb which states that using similar draw weights and similar testing procedures, a well-designed recurve (of the prior art) should shoot the same arrow as a well-designed longbow (of the prior art) approximately 10 fps faster. By comparing the arrow speeds and efficiencies achieved by the bow of the present invention with the most efficient available example of a prior art recurve bow with conventional limbs, the data clearly indicates that present invention provides a significant improvement over the most efficient available example of a prior art recurve bow. Even if the performance and efficiencies of the present invention longbow had only equaled the performance of the prior art recurve, it would have represented a great improvement in the efficiencies of an archery bow. For the present invention longbow to exceed the performance and efficiency of the best available example of a prior art recurve clearly demonstrates the improvements offered by the present invention. The following table shows the above-discussed data in as easy to read format.

| Data | Present Invention Longbow | Prior Art Recurve |
|---|---|---|
| Bow Length, Inches | 64 | 64 |
| Draw Weight @ 30" | 60 | 60 |
| Stored Energy, ft-lbs | 60 | 59 |
| 540 gr. Arrow Speed, fps | 206 | 196 |

-continued

| Data | Present Invention Longbow | Prior Art Recurve |
|---|---|---|
| 540 gr. Arrow KE, ft-lbs | 51 | 46 |
| 540 gr. Arrow Efficiency, % | 85 | 78 |
| 645 gr. Arrow Speed, fps | 196 | 188 |
| 645 gr. Arrow KE, ft-lbs | 55 | 47 |
| 645 gr. Arrow Efficiency, % | 92 | 80 |

The present invention is applicable to all types of archery bows 10. For example, FIG. 3 shows a longbow of the present invention, FIG. 4 shows a recurve bow of the present invention, FIGS. 7, 7*a*, 7*b*, and 7*c* show a compound bow of the present invention, and FIG. 8 shows a split-limb compound bow of the present invention. A bow 10 of the present invention may also be configured as a crossbow, though this configuration is not shown.

Figure 7:
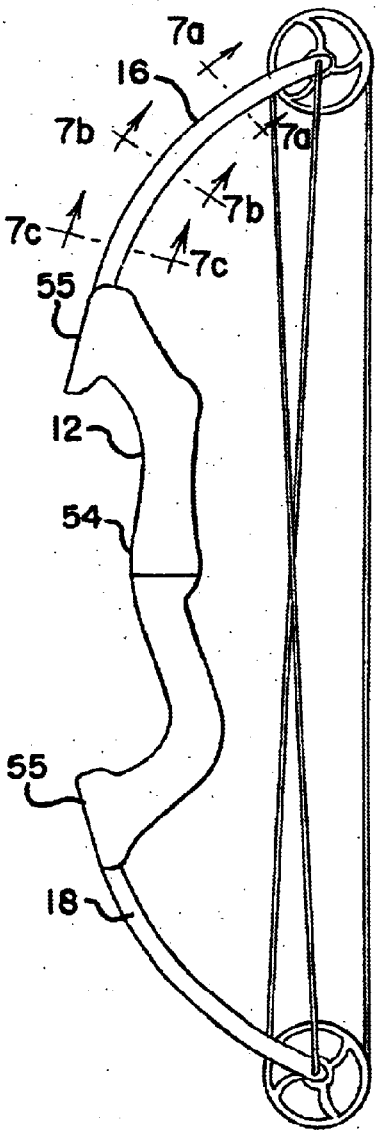
FIG. 7 is a side view of a compound bow of the present invention.
Figure 7A:
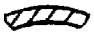
FIGS. 7*a*, 7*b*, and 7*c* show cross-sectional views of the compound bow of FIG. 7 at section lines 7*a*—7*a*, 7*b*—7*b*, and 7*c*—7*c* along the length of a limb.
Figure 7B:
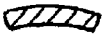
Figure 7C:
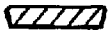
Figure 8:
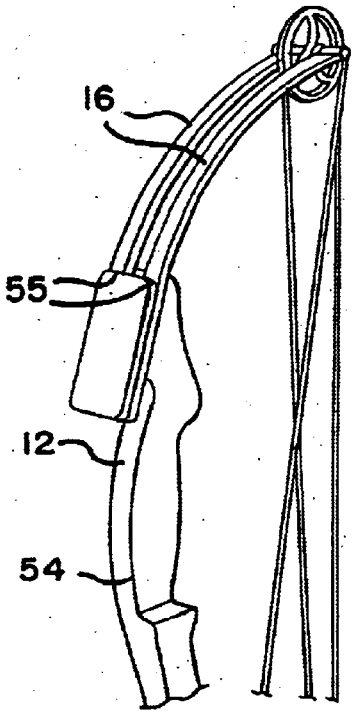
FIG. 8 is a partial perspective view of a split-limb compound bow of the present invention.

As shown in FIG. 7, a compound bow of the present invention may have a handle 12 that is an assembly with a grip 54 and at least one limb mount 55 attached to the grip 54 for attaching a limb 16, 18. As shown in FIG. 7, the compound bow has a handle 12 that is an assembly with a grip 54 and two limb mounts 55 attached to the grip 54 at opposing ends of the grip 54 for attaching the two limbs 16, 18. As shown in FIG. 8, the compound bow may optionally have multiple limb mounts 55 at one end of the grip 54 for attaching multiple limbs 16, 18 to the limb mount 55 in a generally parallel fashion. FIGS. 7 and 8 also show a pulley assembly attached to the distal end 24 of each of the limbs 16, 18, which is common in the art of compound bows.

The present invention can be also be implemented in a recurve or longbow or other bow-type embodiment with the limbs being detachable from the grip 54 with the use of limb mounts 55.

Figure 11:
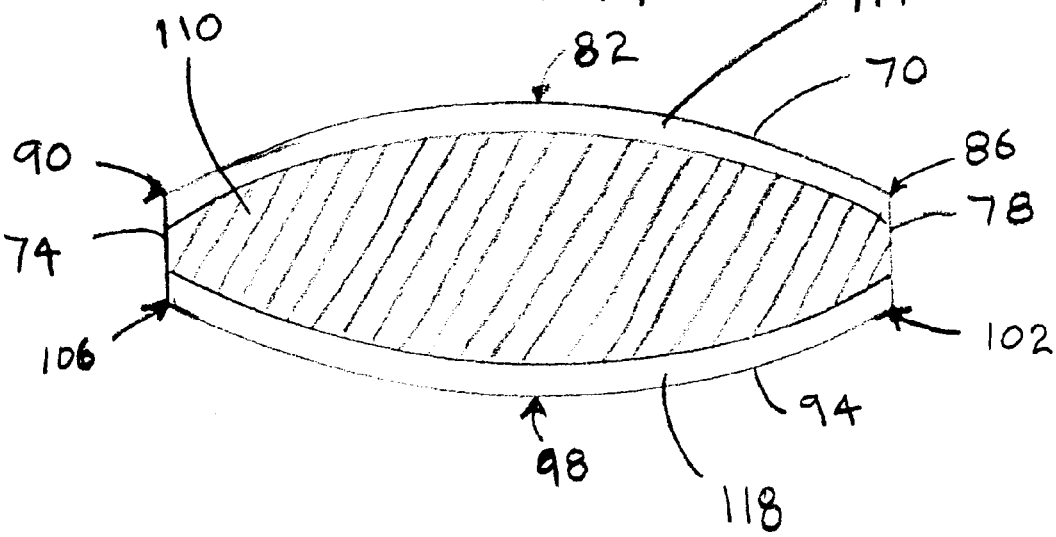
FIG. 11 is a cross-sectional view of a limb of a further embodiment of the present invention.
Figure 12:
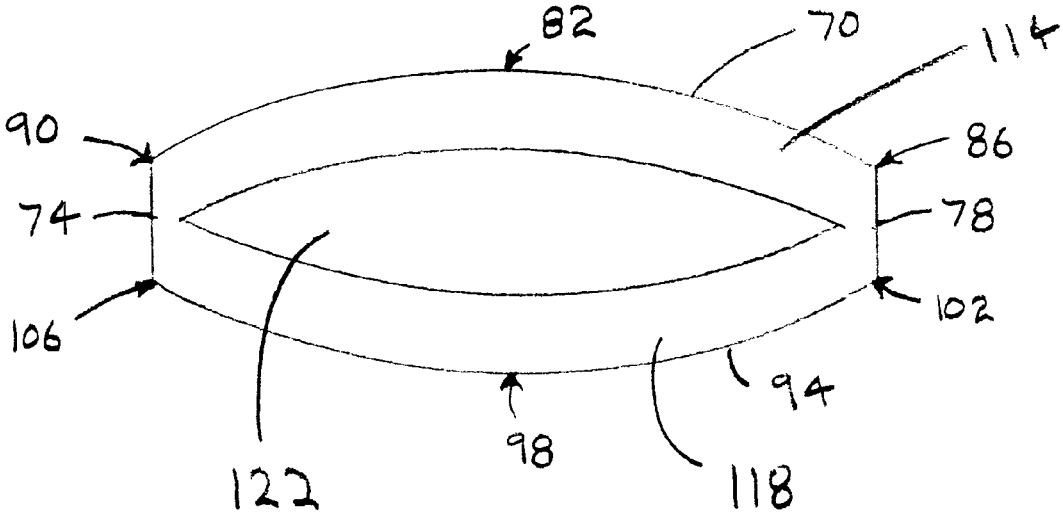
FIG. 12 is a cross-sectional view of a limb of an additional embodiment of the present invention.

Referring to FIGS. 11 and 12, further embodiments of the present invention are shown. Specifically, the limb comprises a first convex surface 70 extending generally between the first and second edges 74,78. The first convex surface 70 has an apex 82 and first and second transition points 86,90 located at opposing sides of the apex 82 of the first convex surface 70. Likewise with previous embodiments, a transverse width is defined by a distance between the transition points 86,90, and the transverse width is substantially unchanged when the bow is drawn to a full draw position as compared to when the bow is in an undrawn position.

In a further embodiment the limb has a second convex surface 94 opposite the first convex surface 70. The second convex surface 94 has a second apex 98 and first and second transition points 102,106 located at opposing sides of the second apex 98 of the second convex surface 94. A second transverse width is defined by a distance between the first and second transition points 102,106 for the second convex surface 94. Likewise, the second transverse width is substantially unchanged when the bow is drawn to a full draw position as compared to when the bow is in an undrawn position. The first and second transition points (86,90 and 102,106) can be the same and/or along the same vertical positions for the first and second convex surfaces, respectively, thereby rendering the first and second transverse widths the same. Likewise, the transverse widths can be the same as the limb width.

In the embodiment shown in FIG. 11, a core layer 110 is disposed between the first and second convex surfaces 70, 94 of the first and second outer layers 114, 118. The core layer 110 can be made of a foam material, such as syntactic foam, which has air pockets substantially evenly dispersed therein. The first and second outer layers 114,118 can be made of materials such as carbon and or fiberglass.

In the embodiment shown in FIG. 12, the first and second convex surfaces define a hollow core 122 of the limb.

While the specific embodiments have been illustrated and described, numerous modifications come to mind without significantly departing from the spirit of the invention and the scope of protection is only limited by the scope of the accompanying Claims.

What is claimed is:

1. A bow comprising:

a handle having a longitudinal axis and first and second handle ends; and, an upper limb and a lower limb extending generally in a direction along the longitudinal axis, each limb comprising first and second edges defining a limb width, a limb thickness, a proximal end, a distal end, and a working region between the proximal and distal ends of each limb, the first and second handle ends being attached to each limb at the respective proximal end of each limb, wherein the proximal end of each limb has a proximal width and the distal end of each limb has a distal width, wherein each limb further comprises a concave surface extending generally between the first and second edges, each concave surface having an opening and first and second transition points located at opposing sides of the opening of the concave surface, wherein a transverse width is defined by a distance between the transition points, wherein the transverse width is substantially unchanged when the bow is drawn to a full draw position as compared to when the bow is in an undrawn position.

2. The bow of claim 1, wherein each limb further comprises a tip located at the distal end of each limb, wherein the working region and the tip of each limb have an optimal weight for improving the efficiency of the limb, the optimal weight being dependent upon at least the limb thickness and the concave surface construction.

3. The bow of claim 1 further comprising:

a waste force defined generally by a total force stored in the bow when the bow is in a drawn position less a transfer force that is transferred to an arrow at the point of release of the arrow, wherein when the bow is drawn to the full draw position and released, and the waste force is less than 25% of the total force stored in the bow when the bow is in the full draw position.

4. The bow of claim 3, wherein the waste force is less than 15% of the total force stored in the bow when the bow is in the full draw position.

5. The bow of claim 3, wherein the waste force is less than 10% of the total force stored in the bow when the bow is in the full draw position.

6. The bow of claim 1 further comprising a draw force that is required to draw the bow to a draw length, wherein the draw force required to draw the bow increases as the draw length increases within the vicinity of the full draw position and beyond the full draw position.

7. The bow of claim 6, wherein as the draw length increases the draw force also increases at substantially all points along a draw path defined by the undrawn position and any useable draw position beyond the full draw position.

8. The bow of claim 1, wherein the concave surface has a radius of curvature when the bow is undrawn, the radius of curvature being substantially unchanged when the bow is drawn to a full draw position.

9. The bow of claim 8, wherein the radius of curvature decreases from the proximal end to the distal end of the limb when the bow is in the undrawn position.

10. The bow of claim 1, wherein the transverse width of the bow in the undrawn position changes by not more than 0.010 inches when the bow is drawn to the full draw position.

11. The bow of claim 1, wherein the transverse width of the bow in the undrawn position changes by not more than 0.005 inches when the bow is drawn to the full draw position.

12. The bow of claim 1, wherein the transverse width of the bow in the undrawn position changes by not more than 0.001 inches when the bow is drawn to the full draw position.

13. The bow of claim 10, 11, or 12, wherein the transverse width is measured at a central position of the working region.

14. The bow of claim 1, wherein the distal width is less than the proximal width.

15. The bow of claim 1, wherein the limb width decreases gradually from the proximal end of the limb to the distal end of the limb.

16. The bow of claim 1, wherein the bow is a longbow.

17. The bow of claim 1, wherein the bow is a recurve bow.

18. The bow of claim 1, wherein each limb is formed of multiple layers extending generally in the direction of the longitudinal axis.

19. The bow of claim 18, wherein the multiple layers comprise at least one core layer positioned between two outer layers, each outer layer having a material therein chosen from a group consisting of at least fiber glass and carbon fiber.

20. The bow of claim 19, wherein at least one core layer is tapered generally in a direction along the longitudinal axis.

21. The bow of claim 1, wherein the bow is a compound bow, and wherein the handle is an assembly comprising a grip and at least one limb mount attached to the grip for attaching at least one limb to the limb mount.

22. The bow of claim 21, wherein the limb mount comprises a first limb mount and a second limb mount for attaching at least two limbs to the limb mount, wherein the limbs are generally parallel when mounted to the limb mount.

23. The bow of claim 1, wherein the bow is a cross bow.

24. The bow of claim 1, wherein the concave surface can be a shape which is at least a part of at least one of a circle, an ellipse, a polygon, and a polygon with curved corners.

25. The bow of claim 1, wherein the concave surface is on a belly side of each limb.

26. The bow of claim 1, wherein the concave surface is on a back side of each limb.

27. A limb for a bow comprising:

first and second edges defining a limb width, a limb thickness, a proximal end, a distal end, and a working region between the proximal and distal ends of the limb, wherein the proximal end of the limb has a proximal width and the distal end of the limb has a distal width, wherein the limb further comprises a concave surface extending generally between the first and second edges, the concave surface having an opening and first and second transition points located at opposing sides of the opening of the concave surface, wherein a transverse width is defined by a distance between the transition points, wherein the transverse width is substantially unchanged when the bow is drawn to a full draw position as compared to when the bow is in an undrawn position.

28. The limb of claim 27 further comprising:

a tip located at the distal end of the limb, wherein the working region and the tip of the limb have an optimal weight for improving the efficiency of the limb, the optimal weight being dependent upon at least the limb thickness and the concave surface construction.

29. The limb of claim 27 further comprising a draw force that is required to draw the bow to a draw length, wherein the draw force required to draw the bow increases as the draw length increases within the vicinity of the full draw position and beyond the full draw position.

30. The limb of claim 29, wherein as the draw length increases the draw force also increases at substantially all points along a draw path defined by the undrawn position and any useable draw position beyond the full draw position.

31. The limb of claim 27, wherein the concave surface has a radius of curvature when the bow is undrawn, the radius of curvature being substantially unchanged when the bow is drawn to a full draw position.

32. The limb of claim 31, wherein the radius of curvature decreases from the proximal end to the distal end of the limb when the bow is in the undrawn position.

33. The limb of claim 27, wherein the transverse width of the bow in the undrawn position changes by not more than 0.010 inches when the bow is drawn to the full draw position.

34. The limb of claim 27, wherein the transverse width of the bow in the undrawn position changes by not more than 0.005 inches when the bow is drawn to the full draw position.

35. The limb of claim 27, wherein the transverse width of the bow in the undrawn position changes by not more than 0.001 inches when the bow is drawn to the full draw position.

36. The limb of claim 33, 34, or 35, wherein the transverse width is measured at a central position of the working region.

37. The bow of claim 27, wherein the concave surface can be a shape which is at least a part of at least one of a circle, an ellipse, a polygon, and a polygon with curved corners.

38. The bow of claim 27, wherein the concave surface is on a belly side of each limb.

39. The bow of claim 27, wherein the concave surface is on a back side of each limb.

40. A bow comprising:

a handle having a longitudinal axis and first and second handle ends;

an upper limb and a lower limb extending generally in a direction along the longitudinal axis, each limb comprising first and second edges defining a limb width, a limb thickness, a proximal end, a distal end, and a working region between the proximal and distal ends of each limb, the first and second handle ends being attached to each limb at the respective proximal end of each limb, wherein the proximal end of each limb has a proximal width and the distal end of each limb has a distal width, wherein each limb further comprises a concave surface extending generally between the first and second edges, each concave surface having an opening and first and second transition points located at opposing sides of the opening of the concave surface, wherein a transverse width is defined by a distance between the transition points; and, a draw force that is required to draw the bow from an undrawn position to a draw length, wherein the draw force required to draw the bow increases as the draw length increases within the vicinity of a full draw position and beyond the full draw position.

41. The bow of claim 40, wherein as the draw length increases the draw force also increases at substantially all points along a draw path defined by the undrawn position and any useable draw position beyond the full draw position.

42. The bow of claim 40, wherein the transverse width is substantially unchanged when the bow is drawn to the full draw position as compared to when the bow is in the undrawn position.

43. The bow of claim 40, wherein the transverse width of the bow in the undrawn position changes by not more than 0.010 inches when the bow is drawn to the full draw position.

44. The bow of claim 40, wherein the transverse width of the bow in the undrawn position changes by not more than 0.005 inches when the bow is drawn to the full draw position.

45. The bow of claim 40, wherein the transverse width of the bow in the undrawn position changes by not more than 0.001 inches when the bow is drawn to the full draw position.

46. The bow of claim 43, 44, or 45, wherein the transverse width is measured at a central position of the working region.

47. The bow of claim 40, wherein each limb further comprises a tip located at the distal end of each limb, wherein the working region and the tip of each limb have an optimal weight for improving the efficiency of the limb, the optimal weight being dependent upon at least the limb thickness and the concave surface construction.

48. The bow of claim 40 further comprising:

a waste force defined generally by a total force stored in the bow when the bow is in a drawn position less a transfer force that is transferred to an arrow at the point of release of the arrow, wherein when the bow is drawn to the full draw position and released, the waste force is less than 30% of the total force stored in the bow when the bow is in the full draw position.

49. The bow of claim 48, wherein the waste force is less than 25% of the total force stored in the bow when the bow is in the full draw position.

50. The bow of claim 48, wherein the waste force is less than 15% of the total force stored in the bow when the bow is in the full draw position.

51. The bow of claim 40, wherein the concave surface has a radius of curvature when the bow is undrawn, the radius of curvature being substantially unchanged when the bow is drawn to a full draw position.

52. The bow of claim 51, wherein the radius of curvature decreases from the proximal end to the distal end of the limb when the bow is in the undrawn position.

53. The bow of claim 40, wherein the distal width is less than the proximal width.

54. The bow of claim 40, wherein the limb width decreases gradually from the proximal end of the limb to the distal end of the limb.

55. The bow of claim 40, wherein the bow is a longbow.

56. The bow of claim 40, wherein the bow is a recurve bow.

57. The bow of claim 40, wherein each limb is formed of multiple layers extending generally in the direction of the longitudinal axis.

58. The bow of claim 57, wherein the multiple layers comprise at least one core layer positioned between two outer layers, each outer layer having a material therein chosen from a group consisting of at least fiber glass and carbon fiber.

59. The bow of claim 58, wherein at least one core layer is tapered generally in a direction along the longitudinal axis.

60. The bow of claim 40, wherein the bow is a compound bow, and wherein the handle is an assembly comprising a grip and at least one limb mount attached to the grip for attaching at least one limb to the limb mount.

61. The bow of claim 60, wherein the limb mount comprises a first limb mount and a second limb mount for attaching at least two limbs to the limb mount, wherein the limbs are generally parallel when mounted to the limb mount.

62. The bow of claim 40, wherein the bow is a cross bow.

63. The bow of claim 40, wherein the concave surface can be a shape which is at least a part of at least one of a circle, an ellipse, a polygon, and a polygon with curved corners.

64. The bow of claim 40, wherein the concave surface is on a belly side of each limb.

65. The bow of claim 40, wherein the concave surface is on a back side of each limb.

66. A limb for a bow comprising:

first and second edges defining a limb width, a limb thickness, a proximal end, a distal end, and a working region between the proximal and distal ends of the limb, wherein the proximal end of the limb has a proximal width and the distal end of the limb has a distal width, wherein the limb further comprises a concave surface extending generally between the first and second edges, the concave surface having an opening and first and second transition points located at opposing sides of the opening of the concave surface, wherein a transverse width is defined by a distance between the transition points; and, a draw force that is required to draw the bow from an undrawn position to a draw length, wherein the draw force required to draw the bow increases as the draw length increases within the vicinity of a full draw position and beyond the full draw position.

67. The limb of claim 66, wherein as the draw length increases the draw force also increases at substantially all points along a draw path defined by the undrawn position and any useable draw position beyond the full draw position.

68. The limb of claim 66, wherein the transverse width is substantially unchanged when the bow is drawn to the full draw position as compared to when the bow is in the undrawn position.

69. The limb of claim 66, wherein the limb further comprises a tip located at the distal end of the limb, wherein the working region and the tip of the limb have an optimal weight for improving the efficiency of the limb, the optimal weight being dependent upon at least the limb thickness and the concave surface construction.

70. The bow of claim 66, wherein the concave surface can be a shape which is at least a part of at least one of a circle, an ellipse, a polygon, and a polygon with curved corners.

71. The bow of claim 66, wherein the concave surface is on a belly side of each limb.

72. The bow of claim 66, wherein the concave surface is on a back side of each limb.

73. A limb for a bow comprising:

first and second edges defining a limb width, a limb thickness, a proximal end, a distal end, and a working region between the proximal and distal ends of the limb, wherein the proximal end of the limb has a proximal width and the distal end of the limb has a distal width, wherein the limb further comprises a first convex surface extending generally between the first and second edges, the first convex surface having an apex and first and second transition points located at opposing sides of the apex of the first convex surface, wherein a transverse width is defined by a distance between the transition points, wherein the transverse width is substantially unchanged when the bow is drawn to a full draw position as compared to when the bow is in an undrawn position.

74. The limb of claim 73 further comprising:

a second convex surface opposite the first convex surface, the second convex surface having a second apex and first and second transition points located at opposing sides of the second apex of the second convex surface, wherein a second transverse width is defined by a distance between the first and second transition points for the second convex surface, wherein the second transverse width is substantially unchanged when the bow is drawn to a full draw position as compared to when the bow is in an undrawn position;

a core layer disposed between the first and second convex surfaces, the core layer having air pockets substantially evenly dispersed therein.

75. The limb of claim 74 wherein the core layer is foam.

76. The limb of claim 73 further comprising:

a second convex surface opposite the first convex surface, the second convex surface having a second apex and first and second transition points located at opposing sides of the second apex of the second convex surface, wherein a second transverse width is defined by a distance between the first and second transition points for the second convex surface, wherein the second transverse width is substantially unchanged when the bow is drawn to a full draw position as compared to when the bow is in an undrawn position, and wherein the first and second convex surfaces define a hollow core of the limb.

77. The limb of claim 76 wherein the first and second transition points are the same for the first and second convex surfaces, respectively.

* * * * *